US012383030B2

(12) United States Patent
Zeng

(10) Patent No.: US 12,383,030 B2
(45) Date of Patent: Aug. 12, 2025

(54) ANNULAR ORNAMENT

(71) Applicant: Chengsheng Zeng, Shenzhen (CN)

(72) Inventor: Chengsheng Zeng, Shenzhen (CN)

( * ) Notice: Subject to any disclaimer, the term of this patent is extended or adjusted under 35 U.S.C. 154(b) by 0 days.

(21) Appl. No.: 18/499,896

(22) Filed: Nov. 1, 2023

(65) Prior Publication Data

US 2024/0057730 A1 Feb. 22, 2024

(30) Foreign Application Priority Data

Dec. 6, 2022 (CN) ..... 202223249478.7

(51) Int. Cl.
*A44C 5/00* (2006.01)
*A44C 5/02* (2006.01)
*A44C 9/02* (2006.01)

(52) U.S. Cl.
CPC ..... *A44C 5/02* (2013.01); *A44C 5/0084* (2013.01)

(58) Field of Classification Search
CPC .... A44C 9/00; A44C 9/02; A44C 5/02; A44C 5/0084
See application file for complete search history.

(56) References Cited

U.S. PATENT DOCUMENTS 3,017,754 A * 1/1962 Manne ..... A44C 9/02 29/441.1
4,480,447 A * 11/1984 Lodrini ..... A44C 9/02 63/15.6
6,748,764 B1 * 6/2004 Roemer ..... A44C 9/02 63/15.5
7,409,836 B2 * 8/2008 Czajka ..... A44C 9/02 63/15.6
9,763,500 B2 * 9/2017 Escobar ..... A44C 17/02
2009/0056373 A1 * 3/2009 Czajka ..... A44C 9/02 63/3
2011/0048073 A1 * 3/2011 Demeglio ..... A44C 9/02 63/15.5
2018/0352916 A1 * 12/2018 Zuluaga Escobar ..... A44C 9/02

FOREIGN PATENT DOCUMENTS

CN 217658457 U 10/2022
FR 1582788 A * 10/1969 ..... A44C 9/02
FR 3080748 A1 * 11/2019 ..... A44C 9/02

* cited by examiner

*Primary Examiner* — Jack W Lavinder

(57) ABSTRACT

The invention discloses annular ornament according, including a body, the body is a ring body structure, the body is provided with an inner ring body, the body and the inner ring body is provided with an elastic sheet; Both ends of the body are provided with a ring body, and the ring body is symmetrically and evenly distributed with a sliding groove; The inner ring is composed of three identical arc-shaped rings. A first slide block is arranged on both sides of the central position of the arc-shaped ring body, and a groove is arranged on the outside of the arc-shaped ring body; The second slider is arranged outside the center position of the elastic sheet; The first and second sliders are located in the sliding groove and rotate up and down.

7 Claims, 3 Drawing Sheets

ANNULAR ORNAMENT

CROSS-REFERENCE TO RELATED APPLICATIONS

This application claims the benefit of priority from Chinese Patent Application No 202223249478.7, filed on Dec. 6, 2022. The content of the aforementioned application, including any intervening amendments thereto, is incorporated herein by reference in its entirety.

TECHNICAL FIELD

The invention relates to the technical field of jewelry, in particular to an annular ornament.

BACKGROUND

The ring-shaped ornaments are mostly ring rings of bracelets and rings.

Bracelets (bangle) are ring-shaped ornaments made of gold, silver, jade and the like and worn on the wrist. According to the structure, the method can be generally divided into two types firstly, the closed ring is made of jade materials; the second is that there are ports or several chain pieces, and most of them are made of metal material.

The bracelet is not easy to wear, and a large bracelet is generally selected to wear, so that the bracelet is easy to loosen on the wrist, prevents the swing of the wrist and is easy to lose.

The annular ornament comprises a body, wherein the body is of a U-shaped annular structure, an inner ring body is arranged in the body, and an elastic sheet is arranged between the body and the inner ring body; the inner ring body is composed of three sections of same arc-shaped ring bodies. This annular ornaments, simple structure, the relative position relation of inner circle body and body is changed in the effect of accessible shell fragment, realizes the adjustment of internal diameter size, has solved the inconvenient problem of wearing, does not influence pleasing to the eye again, and is applicable to the bracelet of jade material or metal material.

In practical application of the prior art, the force application direction of the elastic sheet needs to be perpendicular to the elastic sheet or nearly perpendicular to the elastic sheet, and if the force application is easy to clamp at the joint of the inner ring body, the change of the inner ring body cannot be realized.

SUMMARY OF THE INVENTION

In order to solve the technical defect in the prior art, the annular ornament provided by the invention comprises a body, wherein the body is of a ring body structure, an inner ring body is arranged in the body, and a spring plate is arranged between the body and the inner ring body:

- the two ends of the body are provided with ring body bodies, and the ring body bodies are symmetrically and uniformly distributed with sliding grooves;
- the inner ring body consists of three sections of same arc-shaped ring bodies;
- the two sides of the central position of the arc-shaped ring body are provided with first sliding blocks, and the outer sides of the arc-shaped ring body are provided with grooves;
- a second sliding block is arranged outside the center position of the elastic sheet;

- the first sliding block and the second sliding block are positioned in the sliding groove to rotate and slide up and down.

Furthermore, one end of the arc ring body is provided with an arc opening, and the other end of the arc ring body is provided with an arc tongue matched with the arc opening.

Furthermore, one end of the groove extends outwards to form a sliding tongue, and the other end of the groove is positioned on two side walls of the groove and is provided with a cross rod.

Furthermore, concave platforms are arranged at two ports of the inner wall of the body, and the ring body is fixed on the concave platforms.

Further, the first sliding block and the second sliding block are of cylindrical structures.

Furthermore, the first sliding block and the second sliding block are of square structures.

Furthermore, the sliding tongue is made of flexible materials.

To sum up, the beneficial effects of the invention include, provide an annular ornaments, simple structure, it is more nimble to the adjustment of internal footpath size through the shell fragment, difficult blocking.

DRAWINGS

In order to more clearly illustrate the embodiments of the present invention or the technical solutions in the prior art, the drawings used in the embodiments or the technical solutions in the prior art will be briefly described below, and it is obvious that the drawings in the following description are some embodiments of the present invention, and other drawings can be obtained by those skilled in the art without creative efforts.

Figure 1:
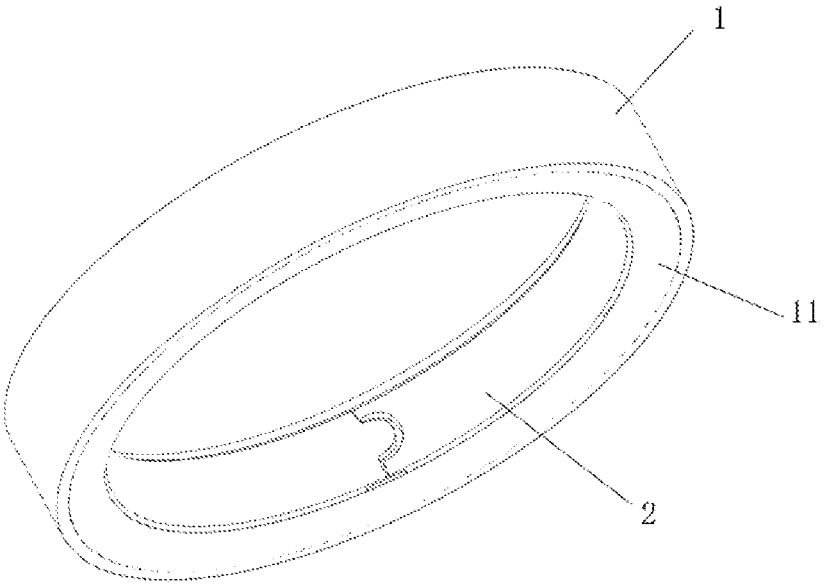
FIG. 1 is an overall schematic view of a first embodiment of the present invention.

- in the figure, a body 1, an inner ring body 2 and a spring plate 3;
- a ring body 11, a concave table 12 and a sliding groove 101,
- an arc-shaped ring body 21;
- a first sliding block 201, a groove 202, a sliding tongue 203 and a cross bar 204;
- an arc-shaped opening 211 and an arc-shaped tongue 212;
- a second slider 301.

DETAILED DESCRIPTION

The technical solution of the present invention will be described clearly and completely with reference to the accompanying drawings, and obviously, the described embodiments are some, but not all embodiments of the present invention. Based on the embodiments in the present invention, all other embodiments obtained by a person skilled in the art without creative work belong to the protection scope of the present invention.

In the description of the present invention, it should be noted that the terms “center”, “upper”, “lower”, “left”, “right”, “vertical”, “horizontal”, “inner”, “outer”, and the like indicate orientations or positional relationships based on orientations or positional relationships shown in the drawings, and are only for convenience of description and simplification of description, but do not indicate or imply that the device or element referred to must have a specific orientation, be constructed and operated in a specific orientation, and thus, should not be construed as limiting the present invention. Furthermore, the terms "first," "second," and "third" are used for descriptive purposes only and are not to be construed as indicating or implying relative importance.

In the description of the present invention, it is to be noted that, unless otherwise explicitly specified or limited, the terms "mounted," "connected," and "connected" are to be construed broadly, and may be, for example, fixedly connected, detachably connected, or integrally connected; can be mechanically or electrically connected, they may be connected directly or indirectly through intervening media, or they may be interconnected between two elements. The specific meaning of the above terms in the present invention can be understood in specific cases to those skilled in the art.

Figure 2:
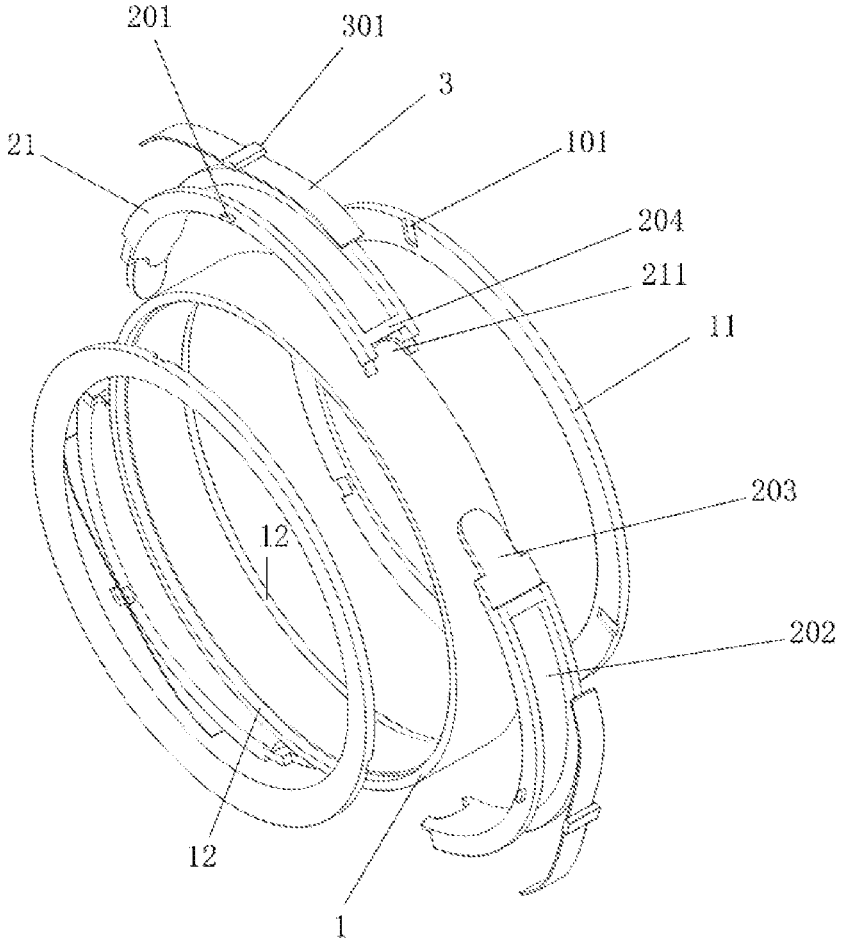
FIG. 2 is a schematic view of an exploded structure in a first embodiment of the present invention.
Figure 3:
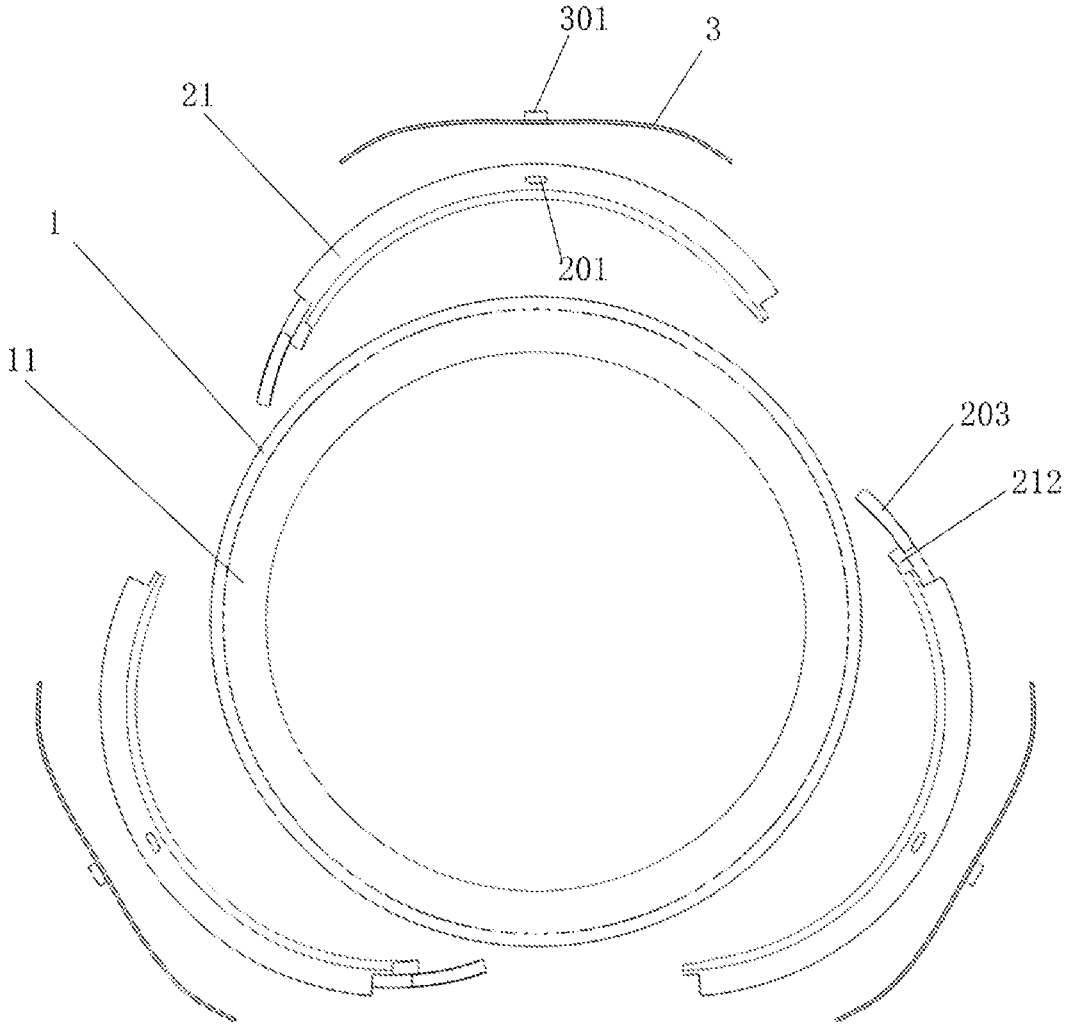
FIG. 3 is a schematic view of an exploded structure in the first embodiment of the present invention.

The first embodiment is as follows: referring to FIG. 1-3, the ring-shaped ornament provided by the present invention comprises a body 1, wherein the body 1 is a ring body structure, an inner ring body 2 is arranged in the body 1, and a spring plate 3 is arranged between the body 1 and the inner ring body 2;

the two ends of the body 1 are respectively provided with a ring body 11, and the ring body 11 is symmetrically and uniformly distributed with sliding grooves 101;

the inner ring body 2 consists of three sections of same arc-shaped ring bodies 21;

the two sides of the center of the arc-shaped ring body 21 are both provided with first sliding blocks 201, and the outer sides of the arc-shaped ring body are both provided with grooves 202;

a second sliding block 301 is arranged outside the central position of the elastic sheet 3;

the first sliding block 201 and the second sliding block 301 are positioned in the sliding groove 101 to rotate and slide up and down.

Further, one end of the arc ring body 21 is provided with an arc opening 211, and the other end is provided with an arc tongue 212 matched with the arc opening 211.

Furthermore, one end of the groove 202 extends outwards to form a sliding tongue 203, and the other end of the groove 202 is provided with cross bars 204 on two side walls.

Furthermore, concave platforms 12 are arranged at two ports of the inner wall of the body 1, and the ring body 11 is fixed on the concave platforms 12.

Further, the first slider 201 and the second slider 301 have a cylindrical structure.

Further, the first slider 201 and the second slider 301 have a square structure.

Further, the sliding tongue 203 is made of a flexible material.

Specifically, the ring body 11 is first installed in the concave 12 on one side of the body 1 and fixed, and the fixing method may be welding or bonding.

Three sections of the same arc-shaped ring body 21 are combined into the inner ring body 2.

The elastic sheets 3 are respectively placed in the grooves 202 on the outer side of the arc-shaped ring body 21, the first sliding blocks 201 and the second sliding blocks 301 are aligned, and then the first sliding blocks 201 and the second sliding blocks 301 on one side are placed into the sliding grooves 101 of the ring body 11 fixed on one side of the body 1.

Then, the sliding groove 101 of the other side ring body 11 is aligned with the first sliding block 201 and the second sliding block 301 of the other side, and the other side ring body 11 is installed on the concave platform 12 of the other side of the body 1.

The second sliding block 301 extends towards the two sides of the elastic sheet 3 and is flush with the first sliding block 201, the first sliding block 201 and the second sliding block 301 are cylindrical, when the elastic sheet 3 is extruded, the first sliding block 201 can rotate in the sliding groove 101 and simultaneously slide upwards, and the second sliding block 301 can rotate in the sliding groove 101 and is more flexible.

The second sliding block 301 is of a square structure, and does not affect the adjustment of the inner ring based on the characteristics of the elastic sheet 3.

After the assembly, under the action of the elastic sheet 3, the arc-shaped opening 211 of the arc-shaped ring body 21 of the inner ring body 2 is detachably attached to the arc-shaped tongue 212 of the other arc-shaped ring body 21, the inner diameter surface of the inner ring body 2 forms a smooth surface, and the sliding tongue 203 extending outwards from one end of the groove 202 at the back of the inner ring body is movably inserted into the groove 202 at the back of the other arc-shaped ring body 21.

The groove 202 is in a U-shaped opening structure, and the sliding tongue 203 can be axially inserted and also can be radially inserted and connected. The groove 202 plays a guiding role for the sliding tongue 203 when the arc-shaped ring body 21 forms the inner ring body 2.

In another embodiment, in order to make the inner ring body 2 composed of the arc-shaped ring body 21 more convenient, the two side walls of one end of the groove 202 are provided with the cross bars 204, the sliding tongue 203 is inserted into the groove 202 through the lower part of the cross bars 204, and meanwhile, in order to solve the problem to be solved in the present application, the sliding tongue 203 is made of a flexible material.

To sum up, the beneficial effects of the invention include, provide an annular ornaments, simple structure, it is more nimble to the adjustment of internal footpath size through the shell fragment, difficult blocking.

It is obvious to a person skilled in the art that the invention is not restricted to details of the above-described exemplary embodiments, but that it can be implemented in other specific forms without departing from the spirit or essential characteristics of the invention. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein, and any reference signs in the claims are not intended to be construed as limiting the claim concerned. Furthermore, it should be understood that although the present description refers to embodiments, not every embodiment may contain only a single embodiment, and such description is for clarity only, and those skilled in the art should integrate the description, and the embodiments may be combined as appropriate to form other embodiments understood by those skilled in the art.

What is claimed is:

1. An annular ornament, comprising:

a main body;

an inner ring body arranged in the main body; and an elastic sheet arranged between the main body and the inner ring body;

wherein two ends of the main body are respectively provided with a ring body, and the ring body is symmetrically and uniformly distributed with sliding grooves;

the inner ring body consists of three arc-shaped ring bodies, wherein two sides of a center of each of the arc-shaped ring bodies are respectively provided with a first sliding block, and outer sides of each of the arc-shaped ring bodies are respectively provided with a groove;

a second sliding block is arranged on an outer side of a central position of the elastic sheet; and the first sliding block and the second sliding block are positioned in the sliding grooves to rotate and slide up and down.

2. The annular ornament according to claim 1, wherein each of the arc-shaped ring bodies is provided with an arc-shaped opening at one end and an arc-shaped tongue matched with the arc-shaped opening at the other end.

3. The annular ornament according to claim 2, wherein a tongue is arranged on one end and a cross bar is arranged on the other end of each of the arc-shaped ring bodies.

4. The annular ornament according to claim 3, wherein the tongue is made of a flexible material.

5. The annular ornament according to claim 1, wherein the main body is provided with recessed platforms at two ports of an inner wall of the main body, and each ring body at each of the two ends of the main body is fixed on the recessed platforms.

6. The annular ornament according to claim 1, wherein the first sliding block and the second sliding block each have a cylindrical configuration.

7. The annular ornament according to claim 1, wherein the second sliding block has a square configuration.

* * * * *